US008052157B2

(12) United States Patent
Holzer

(10) Patent No.: US 8,052,157 B2
(45) Date of Patent: Nov. 8, 2011

(54) BINDING MECHANISM FOR BOARD-TYPE GLIDING DEVICES

(75) Inventor: Helmut Holzer, St. Johann (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 660 days.

(21) Appl. No.: 12/283,369

(22) Filed: Sep. 11, 2008

(65) Prior Publication Data

US 2009/0194956 A1 Aug. 6, 2009

(30) Foreign Application Priority Data

Sep. 12, 2007 (AT) ..... 1427/2007

(51) Int. Cl.
*A63C 9/02* (2006.01)

(52) U.S. Cl. ..... 280/14.24; 280/14.22

(58) Field of Classification Search ..... 280/14.22, 280/14.24, 618, 634
See application file for complete search history.

(56) References Cited

U.S. PATENT DOCUMENTS

| | | | | |
|---|---|---|---|---|
| 5,577,755 | A * | 11/1996 | Metzger et al. | 280/607 |
| 5,791,678 | A * | 8/1998 | Perlman | 280/618 |
| 5,868,416 | A * | 2/1999 | Fardie | 280/607 |
| 6,015,161 | A * | 1/2000 | Carlson | 280/626 |
| 6,062,584 | A * | 5/2000 | Sabol | 280/607 |
| 6,155,578 | A * | 12/2000 | Patterson | 280/14.24 |
| 6,234,494 | B1 | 5/2001 | Gien | |
| 6,467,794 | B1 * | 10/2002 | De France | 280/607 |
| 6,505,841 | B1 * | 1/2003 | Kessler et al. | 280/14.22 |
| 6,520,531 | B1 * | 2/2003 | Gien | 280/618 |
| 6,575,489 | B1 * | 6/2003 | White | 280/613 |
| 6,910,706 | B2 * | 6/2005 | Holzer et al. | 280/618 |
| 6,910,707 | B1 * | 6/2005 | Lyng | 280/618 |
| 6,945,544 | B2 * | 9/2005 | Feurer et al. | 280/14.22 |

(Continued)

FOREIGN PATENT DOCUMENTS

AT 393 797 6/1991

(Continued)

OTHER PUBLICATIONS

Austrian Office Action dated Jul. 9, 2008 with English translation of the relevant parts.

*Primary Examiner* — Jeffrey J Restifo
(74) *Attorney, Agent, or Firm* — Collard & Roe, P.C.

(57) ABSTRACT

The invention relates to a binding mechanism (1) for board-type gliding devices, in particular a snowboard binding, provided with a retaining plate (12) for a base plate (11) for securing it to a gliding board body. A setting and fixing device (23) is provided, which can be switched into at least three selectively assumable operating modes and is designed so that (i) in a first operating mode, an anti-rotation lock and an anti-lift lock for the base plate (11) are activated, (ii) in a second operating mode, the anti-rotation lock is inactive and the anti-lift lock is active, and (iii) in a third operating mode, the anti-rotation lock and the anti-lift lock are inactive. The retaining plate (12) is therefore rigidly connected to the top face (13) of a gliding board body and is immobile in the direction perpendicular to it both when the anti-rotation lock (41) is deactivated in order to change the position of angular rotation (20) and when the anti-lift lock (42) is deactivated in order to remove or fit the base plate (11).

31 Claims, 6 Drawing Sheets

U.S. PATENT DOCUMENTS

| | | | | |
|---|---|---|---|---|
| 7,063,346 | B2 * | 6/2006 | Elkington | 280/618 |
| 7,090,228 | B2 * | 8/2006 | Reynolds | 280/14.24 |
| 7,168,710 | B1 * | 1/2007 | Hennebry | 280/14.24 |
| 7,281,717 | B2 * | 10/2007 | Sacco et al. | 280/14.22 |
| 7,334,810 | B2 | 2/2008 | Holzer et al. | |
| 7,384,048 | B2 * | 6/2008 | Cerrito | 280/14.22 |
| 7,658,398 | B2 * | 2/2010 | Panzeri | 280/618 |
| 2003/0020246 | A1 | 1/2003 | Gien | |
| 2009/0194956 | A1 * | 8/2009 | Holzer | 280/14.24 |

FOREIGN PATENT DOCUMENTS

| | | |
|---|---|---|
| AT | 411 016 | 9/2003 |
| DE | 200 00 947 | 5/2000 |
| EP | 1 797 930 | 6/2007 |
| FR | 2 725 140 | 4/1996 |
| FR | 2 743 306 | 7/1997 |
| WO | WO 97/33664 | 9/1997 |
| WO | WO 00/04964 | 2/2000 |

* cited by examiner

BINDING MECHANISM FOR BOARD-TYPE GLIDING DEVICES

In accordance with 35 U.S.C. §119, the applicants claim the priority of Austrian patent application No. 1427/2007 dated 12 Sep. 2007.

BACKGROUND OF THE INVENTION

1. Field of the Invention

The invention relates to a binding mechanism for board-type gliding devices, in particular a snowboard binding, of the type specified in the introductory part of claim 1.

2. Prior art

Patent specifications WO 97/33664 A1 and WO 00/04964 A1 disclose a snowboard binding, whereby the base plate for supporting a user's foot can not be detached or removed from the retaining plate screwed to the snowboard except with the aid of tools. In particular, fastidious and awkward dismantling operations would have to be carried out on the snowboard binding in order to remove the base plate from the snowboard. With this design, therefore, the base plate is always mechanically connected to the circular retaining plate and snowboard. However, no provision is made for an end user or retailer of such bindings to effect a relative displacement between the retaining plate and the base plate in the vertical direction towards the top face of the snowboard. The slide elements which can be displaced radially with respect to the circular retaining plate act by means of their teeth in the outer mutually remote end portions solely as an anti-rotation lock for the base plate relative to the snowboard which can be activated and deactivated as and when required, and when the slide elements are in the extracted position, any rotating movement of the base plate relative to the central retaining plate is blocked. When the slide elements are in the retracted position, the angle of rotation of the base can be adjusted relative to the longitudinal axis of the snowboard. Although the angular position of the binding relative to the snowboard can be changed comfortably and without tools on the basis of this design, the base plate together with the components disposed on it can not be readily and rapidly removed or detached from the snowboard.

Patent specification FR 2 743 306 A1 also discloses a snowboard binding with a circular retaining plate designed to be rigidly connected to a snowboard, comprising two slide elements which can be displaced radially relative to its centre. When these slide elements are in a position extracted from the retaining plate, they act as an anti-rotation lock for the pivot bearing between the base plate and retaining plate. Disposed between the outer peripheral portion of the circular retaining plate and the peripheral portions around the co-operating orifice in the base plate are rigid overlaps or stable retaining flanges, which permanently prevent a relative displacement of the base plate in the direction perpendicular to the top face of the snowboard and in the direction perpendicular to the mounting plane of the binding mechanism. In the assembled state, the projections in the circumferential portion of the retaining plate and in the peripheral portion of the circular orifice in the base plate act as rigid overlaps or retaining lugs which establish a permanent lock preventing the base plate from being removed from the retaining plate. Again with this design, therefore, the base plate can not be detached or removed from the snowboard other than by completely unscrewing it and removing the retaining plate from the snowboard.

Patent specification EP 1 797 930 A1 proposes a design whereby the disc-shaped retaining mechanism for the base plate of a snowboard binding can be raised and lowered in the vertical direction with respect to the top face of a gliding board to permit and prevent a rotating movement of the base plate relative to the retaining mechanism. A retaining plate of this retaining mechanism is designed so that it can be positively coupled with pin-type projections on the top face of the gliding board and uncoupled from these pin-type projections in the vertical direction so that when the disc-shaped retaining mechanism and base plate are removed from the gliding board, only the pin-type projections remain on the gliding board. To this end, two comb-like or rake-like lock elements are provided in the retaining mechanism, which are able locate round the head of the pin-type projections either without any clearance, with a vertical clearance or can be uncoupled from the pin-type projections. Also proposed is an operating lever which enables the retaining plate to be raised from the base plate to a limited degree on assuming an intermediate position so that the position of angular rotation of the base plate can be adjusted relative to the retaining plate. In this intermediate position in which the retaining plate is loosened, the base plate is totally prevented from being removed from the gliding board. The disadvantage of this is that this design requires a large number of components with particularly low dimensional tolerances, which means that a binding mechanism of this type is complex to produce and cost-intensive. Furthermore, a person using or adjusting the binding mechanism can not easily tell whether the retaining plate is secured so that the base plate will be retained correctly. In particular, it is not possible to tell visually in what position the pin-type projections have located with the retaining plate and whether they have established a positive connection correctly. Assembling and dismantling the retaining plate and base plate require a high level of skill or some practical experience with binding mechanisms because the pin-type projections and the comb-like or rake-like lock elements are not visible from above. The ability of the retaining plate to lift vertically relative to the top face of the gliding board is also critical in view of the risk of ice or snow collecting underneath the retaining plate. Moreover, relatively tight dimensional tolerances are necessary when securing the pin-type projections on the top face of the gliding board body in order to establish a sufficiently strong and clearance-free connection between these pin-type projections and the retaining plate once the retaining plate and its operating lever are in the locked operating or operation-ready position.

The applicant's patent specification AT 411 016 B describes a snowboard binding which has what in plan view is a circular retaining plate for mounting on a snowboard for a base plate with a relatively large surface. Disposed on this retaining plate is at least one slide element which can be moved from an extracted position, in which it spans or overlaps a transition region between the retaining plate and the base plate, into a retracted position, in which the slide element does not span or overlap the transition region between the retaining plate and base plate, and vice versa. In the extracted position, the at least one slide element acts as a lock to prevent the base plate from lifting from the retaining plate in the vertical direction by reference to its mounting plane. When the at least one slide element is in the retracted position, the base plate can be lifted from the retaining plate and snowboard. In order to activate and deactivate the lock between the retaining plate and base plate to prevent lifting when necessary, a setting and fixing device is provided on the retaining plate, which can be operated without tools. The two operating modes of the setting and fixing device, in particular the active and inactive mode of the setting and fixing device, thus enable convenient fitting and dismantling or replacement of the base plate on the snowboard. In order to change the angle of rotation between the base plate and retaining plate, the base plate is lifted from the retaining plate at least slightly when the anti-lift lock is switched to the inactive mode so that the teeth between the retaining plate and base plate disengage and the base plate can then be re-set in the desired position of angular rotation. The user-friendliness and convenience achieved as a result is relatively high but is still not sufficiently satisfactory for all users and situations.

OBJECTIVES AND ADVANTAGES OF THE INVENTION

The underlying objective of this invention is to propose a binding mechanism for board-type gliding devices, in particular a snowboard binding, which offers a higher degree of operating convenience and user-friendliness in terms of changing the angle of rotation and which is as simple as possible to fit and dismantle.

This objective is achieved on the basis of a binding mechanism as defined in claim 1.

The advantage of the binding mechanism proposed by the invention is that the three selectively activatable operating modes of the setting and fixing device enable rapid and unmistakable or simplified manipulation of the binding mechanism. As proposed by the invention, a user or operator of the binding mechanism can specifically activate clearly pre-defined operating modes and associated functions. In particular, without the need for additional tools, it is possible to change or re-set the angle of rotation of the base plate or take off and remove the base plate from the retaining plate which remains fixedly mounted on the gliding board body. Of particular advantage is the fact that a separate setting mode B can be set with the setting and fixing device, in which the base plate can be turned relative to the retaining plate without necessarily having to lift the base plate from the retaining plate to do this. A different and separate operating mode C can also be set, in which the base plate can be completely removed from the retaining plate and from the snowboard. One particular advantage resides in the fact that when operating mode B is assumed, in which only the anti-rotation lock is inactive, only the anti-lift lock continues to remain active so that the base plate is prevented from falling off or working loose from the snowboard and from the retaining plate. This is of particular advantage if it is necessary to change or re-set the angle of rotation of the base plate when the binding mechanism is in use, especially on a piste or in open country. The binding mechanism proposed by the invention therefore avoids the risk of snow accumulating and compressing underneath the retaining plate or underneath the base plate when the anti-rotation lock is deactivated, in other words when it assumes the second operating mode B in which it is possible to change the position of angular rotation of the base plate. In particular, on assuming the second operating mode B, neither the retaining plate nor the base plate can be lifted from the top face of the gliding board body, but remain mounted on the retaining plate and base plate with virtually no gap or clearance with respect to the top face of the gliding board body. In particular, when the base plate assumes operating mode B, it should not be possible to lift it from the top face of the gliding board body by more than approximately 2 mm. This means that the functional suitability and functional reliability of the binding mechanism are assured even if it has to be re-adjusted under difficult conditions or after icing up. Handling of the binding mechanism overall is particularly simple and comfortable with respect to the retaining plate pre-mounted on the gliding board body so that even untrained persons or end users can re-adjust the binding mechanism without difficulty.

The advantageous features defined in claim 2 ensure that no snow can accumulate and no ice can build up underneath the base plate or retaining plate, even when the position of angular rotation of the base plate is changed during use of the binding mechanism or in open country. This increases the functional reliability and operating safety of the binding mechanism.

The features defined in claim 3 impart a dual function to the at least one slide element on the retaining plate, which means that the binding mechanism can be assembled as cost-effectively as possible.

A design defined in claim 4 is also of advantage because only one actuator drive is provided, which functionally acts on both the anti-rotation lock and the anti-lift lock. This enables the number of components needed to be kept as low as possible on the one hand and means that the user only has to operate one operating element in order to operate the actuator drive accordingly on the other hand. In addition to saving on components and manufacturing costs, the weight of the binding mechanism is also reduced.

The design defined in claim 5 or 6 ensures that the anti-rotation lock and the anti-lift lock can be deactivated separately from one another or uncoupled. Nevertheless, only a single actuator drive is provided, by means of which the anti-rotation lock and the anti-lift lock can be separately deactivated. This keeps the complexity and weight of the binding mechanism as low as possible.

Due to the design defined in claim 7, there is only a single operating mode in which the base plate can be removed from the retaining plate and fitted on the retaining plate and snowboard. Incorrect use and inadvertent loosening of the base plate from the retaining plate can therefore be better prevented.

Due to the design defined in claims 8 and 9, unintentional releasing or jumping to operating modes that are relevant to safety is prevented. In particular, the reliability and operating safety of the binding mechanism are increased because when the anti-lift lock is activated, the anti-rotation lock is also necessarily activated at the same time. Above all, this reliably prevents the anti-lift lock from being activated whilst the anti-rotation lock remains inactive when a base plate together with the components mounted on it for subsequent use is fitted on or attached to the retaining plate or the corresponding snowboard.

The advantage of the design defined in claim 10 is that the retaining plate can always remain rigidly and non-flexibly connected to the gliding board body and the functions of the selectively activatable and deactivatable anti-lift lock and the selectively activatable and deactivatable anti-rotation lock are selected exclusively via the at least one slide element which can be displaced relative to the retaining plate. Specifically, in order to deactivate the anti-rotation lock, it is not necessary to loosen the retaining plate and undo or loosen the lock of the safety-critical retaining plate on the gliding board body and instead, as a result of the claimed design, the retaining plate remains rigidly connected to the top face of the gliding board body when changing the position of angular rotation of the base plate.

Due to the features defined in claim 11, the anti-rotation lock can be deactivated and activated by structurally simple means and in a particularly robust manner.

The features defined in claim 12 also ensure that the retaining plate can remain rigidly connected to the top face of a co-operating gliding board body, for example by means of conventional fixing screws, when it is desirable to change the position of angular rotation of the base plate. In particular as a result of these features, only the anti-rotation lock is deactivated when the second operating mode B is assumed. The anti-lift lock between the retaining plate and base plate nevertheless remains active and is maintained.

As a result of the design defined in claim 13, the teeth and the retaining projection are separate in terms of their construction and disposition, which means that they can each be optimally dimensioned and disposed or positioned. This also ensures that it is possible to check visually and rapidly that the anti-lift lock is functioning correctly and in the relevant mode. It is also possible to tell quite clearly that when the anti-lift lock has been correctly activated, the anti-rotation lock has also been activated because the anti-lift and anti-rotation lock establish a functional coupling. In particular, when the operator or user checks the binding mechanism to ensure that the anti-lift lock is in the active mode, he can be certain that the base plate is correctly retained by the retaining plate, i.e. is also retained so that it is not able to turn and is thus safe to use.

As a result of the design defined in claim 14, individual slide elements of the total number of slide elements assume exclusively the function of an anti-rotation lock and thus assist the retaining torque of whichever slide element is fulfilling the function of both an anti-rotation lock and an anti-lift lock. In particular, therefore, the retaining torque can be increased to prevent undesirable turning between the base plate and retaining plate. Moreover, relatively fine teeth may be provided between the slide elements and base plate, which permit a relative displacement with relatively short angular steps but which nevertheless guarantee a sufficiently strong retaining torque.

As a result of the design defined in claim 15, a robust pivot bearing can be assembled relatively inexpensively between the retaining plate and base plate. In particular, this pivot bearing also remains reliable and functionally stable under rough environmental conditions, e.g. under the influence of snow or ice.

The design defined in claim 16 advantageously ensures that even if the angle of rotation of the base plate is changed under difficult conditions, for example in deep snow, or if the gliding board is covered by snow or if there is snow in the binding, no snow or ice can build up underneath the base plate. Specifically, when the angle of rotation of the base plate relative to the retaining plate is being changed, there is barely any risk of snow or ice collecting underneath the base plate because the base plate remains directly on the top face of the gliding board body when its angle of rotation has to be changed. The functionality and user safety of the binding mechanism proposed by the invention can therefore be significantly increased because operating errors or carelessness or thoughtlessness when operating the binding mechanism can not lead to critical safety errors in terms of the binding mechanism.

The advantage of the design defined in one or more of claims 17 to 19 is that, due to the at least two slide elements on the retaining plate, the fitting and dismantling operation can be effected more easily and faster. In particular, the base plate can also be fitted on the retaining plate and on the co-operating snowboard by technically untrained operators without any difficulty, after which the slide elements merely have to be switched to the extracted position in order to establish a reliable mechanical connection. The manipulations needed for fitting and dismantling and in order to adjust the angle of rotation between the base plate and retaining plate are therefore intuitive for a user and can be effected extremely quickly. The manipulations can also be effected without difficulty even when wearing gloves.

Based on the design defined in claim 20, an actuator drive is provided, which is able to transmit a strong force but is nevertheless of a simple construction. Such a design is also robust and free of joint connections which are susceptible to icing.

The advantage of the design defined in claim 21 is that such a drive mechanism can also be used to effect a strong and reliable locking action for the setting and fixing device. Above all, by moving beyond the maximum extended position of the connecting rod or coupling rod, in particular by moving beyond the top dead centre of the articulated joint between the coupling disc and connecting rod, the setting and fixing device can be automatically and reliably locked. In particular, it is advantageously possible to use the top dead centre position of this mechanical displacement coupling to establish a simple locking action for the first operating mode A.

A design defined in claim 22 or 23 is of advantage because a coupling mechanism of this type can be produced inexpensively and reliably and converts a rotating movement of the coupling disc into a linear movement of the slide elements.

The advantage of the embodiment defined in claim 24 is that a translation of force and distance is achieved which enables the setting and fixing device to be reliably locked on the one hand. In addition, in spite of the fact that the turning widths or angular steps of the handle or coupling disc of the setting and fixing device remain the same, it is advantageously possible to obtain different positioning widths for the slide elements coupled with it. In particular, pairs or groups of slide elements may be provided which move by different and in particular longer or shorter adjustment distances than another pair or another group of slide elements. Accordingly, this makes it easier to make allowance for the amount of space available on the retaining plate and meet the high strength requirements needed for the slide elements. Above all, the slide elements moved by means of slide guides travel a shorter adjustment distance when switched from the second operating mode B to the third operating mode C than the second group of slide elements, which are preferably coupled with the setting and fixing device via connecting rods.

The advantage of the embodiment defined in claim 25 is that optimum strength and guiding accuracy of the slide elements is obtained but there is still sufficient space to provide bores or orifices to secure the retaining plate on the top face of a gliding board body. In particular, the slide elements which can be moved via the slide guides make it easier to provide a number of fixing bores of large dimensions for fixing screws, whilst the slide elements articulatingly linked via connecting rod-couplings provide a reliable and simple locking mechanism for the setting and fixing device when the anti-rotation lock assumes the active position and the anti-lift lock also assumes the active position at the same time.

The design defined in claim 26 provides a handle which is able to assume at least two positions. In particular, an operating position reached by an ergonomically designed handle can be assumed in which the actuator drive can be operated comfortably and with force. In addition, the handle is able to assume a compact non-operating position once the desired setting or adjustment has been made, thereby resulting in a binding mechanism that is as compact as possible and has barely any protruding parts. This also minimizes the risk of injury when using the binding mechanism.

Another embodiment defined in claim 27 or 28 is of particular advantage because it ensures that the binding mechanism is not operational or ready to use unless the handle has assumed a correct or intended locked position. Otherwise, use of the binding mechanism, in particular stepping into the binding mechanism with a co-operating sports show or snowboard shoe, is prevented or made more difficult. This is achieved due to the fact that in all positions other than the locked position, the handle protrudes out from the standing surface, in particular the top face of the retaining plate, so that a user is clearly able to see that the binding mechanism in is not fit for use or is in an unlocked operating state. This can prevent or reduce accidents or use of the binding mechanism during operating modes with impaired performance.

A design defined in claim 29 is also of advantage because a rotating movement effected by a user is converted into a linear movement for the slide elements, and sufficiently long adjustment distances for the slide elements can be effected by moving by a relatively short angle of rotation. Another particular advantage is the fact that the respective operating modes of the setting and fixing device are easily and visually obvious due to the respective position of angular rotation of the co-operating handle relative to the recess in the top face of the retaining plate, which means that the operator or user can see what the respective operating mode is without any misunderstanding.

Another embodiment defined in claim 30 is of advantage because the pinion or coupling disc is able to rotate indirectly to a limited degree. Specifically due to the limited displacement distances of at least one slide element, the range of angular rotation of the pinion or coupling disc is also limited. The range of angular rotation can therefore be limited in a relatively simple but nevertheless robust manner in terms of construction.

Finally, another embodiment defined in claim 31 is also of advantage because even if the base plate and retaining plate have not been positioned absolutely exactly with respect to one another by the user, an automatic orientation or self-adjustment can be made. In particular, due to the keying action of the slide elements during the transfer of the setting and fixing device into the locking position or first operating mode, a correct orientation and a coupling with as little clearance as possible is obtained between the retaining plate and base plate. Furthermore, this is more conducive to avoiding blockade positions and relative positions which will prevent the desired coupling between the retaining plate and the base plate to be fitted because the wedge-type, pointed slide elements can be switched relatively reliably into the intended positive fit with the base plate.

BRIEF DESCRIPTION OF THE DRAWINGS

Advantageous embodiments of the invention will be described in more detail below on the basis of examples of embodiments illustrated in the appended drawings. Of these.

DETAILED DESCRIPTION OF PREFERRED EMBODIMENTS

Figure 1:
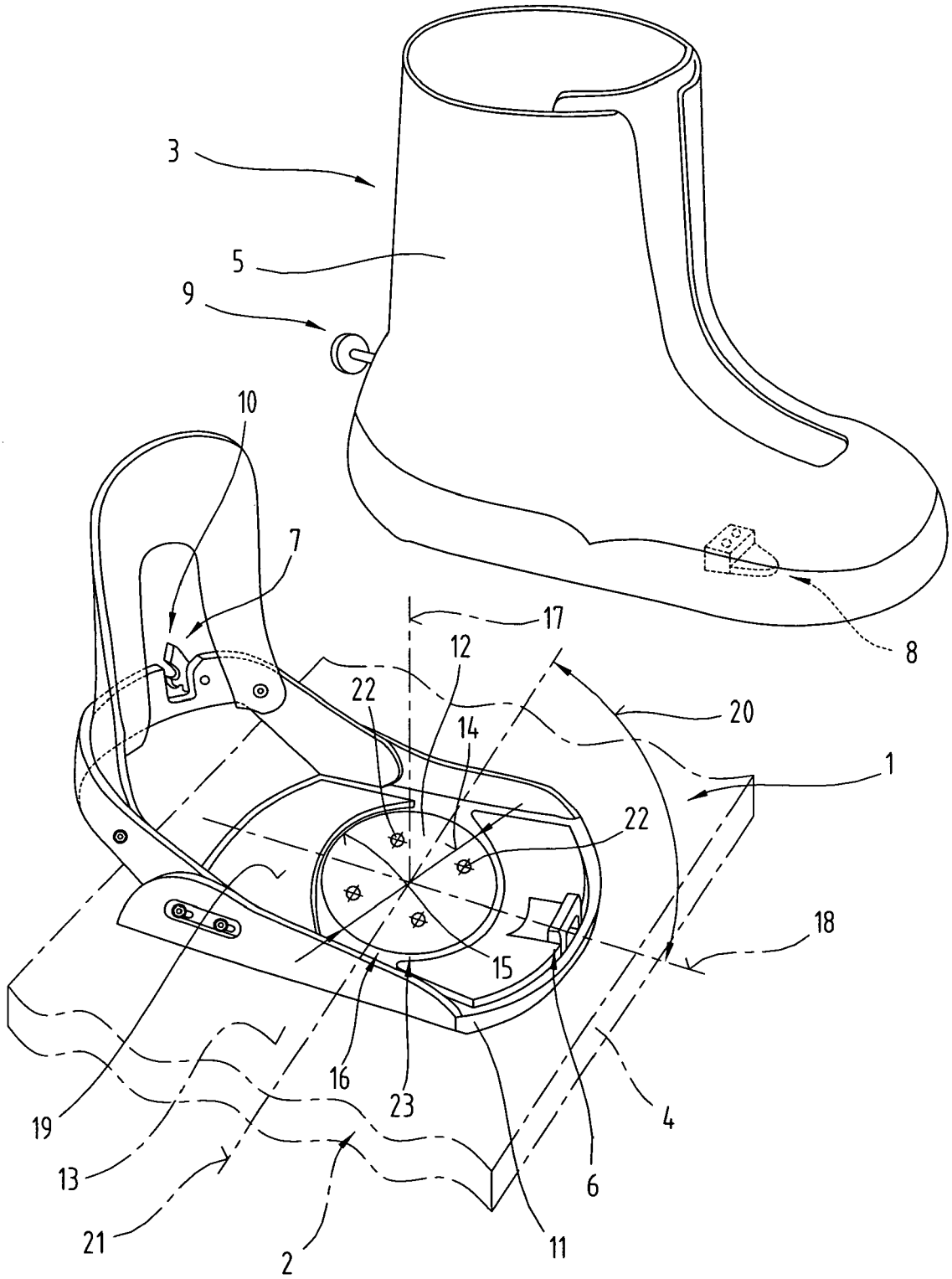
FIG. 1 is a highly simplified, perspective diagram illustrating an example of an embodiment of a binding mechanism for releasably connecting a snowboard shoe to a snowboard.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

FIG. 1 shows a perspective view of a binding mechanism 1 for releasably connecting a gliding device, in particular a board-type sports device 2, to a sports shoe 3 as and when necessary. By preference, the sports device 2 is a so-called snowboard 4 on which the binding mechanism 1 for releasably connecting to an appropriately designed snowboard shoe 5 is mounted.

In the embodiment illustrated as an example, the binding mechanism 1 comprises at least one coupling part 6, 7 for establishing a connection to at least one co-operating coupling part 8, 9 on the sports shoe 3 that will release when necessary. The coupling parts 6 to 9 thus form a catch coupling 10 and what is known as a "step-in system" for comfortably and rapidly connecting and releasing the sports shoe 3 and binding mechanism 1.

Within the scope of the invention, however, the coupling parts 6, 7 of the binding mechanism 1 may also be provided in the form of at least one strap arrangement of a type known per se. These strap arrangements known from the prior art have at least one strap-shaped tensioning element with a buckle or some other clamping device, by means of which the sports shoe 3 can be firmly strapped in the binding mechanism 1 and released again in order to step out of the binding mechanism 1.

The binding mechanism 1 also has a largely flat base plate 11, which is retained on the top face 13 of the snowboard 4 by means of a retaining plate 12. As seen in plan view, the base plate 11 may approximately have the contour of a shoe sole. However, it would also be possible for the base plate 11 to be provided in the form of a beam-shaped support with coupling elements disposed in oppositely lying end portions to provide a connection to an appropriately designed shoe.

As seen in plan view, the retaining plate 12 for retaining the base plate 11 and the entire binding mechanism 1 on the snowboard 4 has an approximately circular contour. A thickness of the wheel-like retaining plate 12 approximately corresponds to a thickness of the base plate 11. A diameter 14 of the retaining plate 12 may be 70 mm to 140 mm, preferably approximately 105 mm.

In its central region, the base plate 11 has a circular or at least in certain portions circular orifice 15 or an appropriate cut-out, the diameter of which essentially corresponds to the diameter 14 of the retaining plate 12. The retaining plate 12 and the base plate 11 can be at least partially inserted one in the other via the orifice 15 or cut-out and positively connected to one another. The disc-shaped retaining plate 12 in conjunction with the complementary orifice 15 or co-operating bore constitutes a pivot bearing 16 for the base plate 11 relative to the top face 13 of the snowboard 4 which can be locked and released as and when necessary. In particular, this pivot bearing 16 constitutes an axis 17 oriented essentially vertically with respect to the base plate 11 or top face 13 of the snowboard 4, which extends parallel with and is congruent with the binding vertical axis.

Instead of conforming to the sole shape of the sports shoe 3, the base plate 11 may be of an asymmetrical design relative to a binding longitudinal axis 18. This binding longitudinal axis 18 preferably extends through the centre of the retaining plate 12 and is oriented essentially parallel with a standing plane 19 for the sports shoe 3. The standing plane 19 for the sports shoe 3 on the base plate 11 may extend largely parallel with the top face 13 of the snowboard 4 or, in order to provide a so-called "canting", may also be oriented at an angle with respect to the top face 13 of the snowboard 4.

The selectively lockable and releasable pivot bearing 16 between the retaining plate 12 and base plate 11 enables the binding mechanism 1 to be set in different positions of angular rotation relative to the snowboard 4. In particular, in a manner known per se, it is possible to change an angle of rotation 20 between the binding longitudinal axis 18 and a longitudinal axis 21 of the snowboard 4 to suit the wishes of a user and then fix the desired angle of rotation 20. In particular, the angle of rotation 20 can be adjusted by means of this pivot bearing 16 in any angular position, from that known as "regular" to that known as "Goofy" and vice versa. By means of this pivot bearing 16, it is also possible to orient the binding longitudinal axis 18 from an orientation parallel with the longitudinal axis 21 to an orientation extending transversely to or at a right angle to the longitudinal axis 21. The pivot bearing 16 is preferably of a lockable and releasable design but does not have stops, thereby permitting an infinite adjustment range of more than 360° for the angle of rotation 20.

In a manner known per se, at least two binding mechanisms 1 are mounted on a snowboard 4, which are either identical or designed for the right and left foot. To this end, it is standard practice to provide a plurality of fixing screws 22, which extend through the retaining plate 12 and can be anchored in the snowboard 4 in order to retain the binding mechanism 1 on the top face 13.

These fixing screws 22 based on a design known from the prior art also fulfill the function of an adjusting means for the angle of rotation 20 or for the pivot bearing 16. In order to change the angle of rotation 20, it would be necessary to loosen all the fixing screws 22 for the retaining plate 12, set the angle of rotation 20 of the base plate 11 as desired and tighten the fixing screws 22 again with a high rotary torque. This requires tools on the one hand, such as a screwdriver for example, and the operations which have to be carried out on the previously known bindings require a relatively large amount of time.

FIGS. 2 to 6 illustrate an improved embodiment of a retaining plate 12 with a setting and fixing device 23 for the base plate 11 of a snowboard binding. This setting and fixing device 23 on the retaining plate 12 makes it possible to change the angle of rotation 20 without tools—FIG. 1—and fit and detach the base plate 11 together with the components mounted on it on and from a snowboard 4. The description given in connection with FIGS. 2 to 6 below should be read in conjunction with FIG. 1.

As clearly illustrated by the diagrams given in FIGS. 2 to 6, the improved setting and fixing device 23 between the retaining plate 12 and base plate 11 has at least one positioning or slide element 24, preferably at least two or four slide elements 24, 25. In the case of the embodiment illustrated, there are four slide elements 24, 25, which are retained on the retaining plate 12 and are mounted so that they are able to move relative to it. The first slide elements 24, preferably arranged in pairs, can be moved from a completely or maximum extracted position 26—FIG. 3—into at least two relatively retracted positions 27*a*—FIG. 4—and 27*b*—FIG. 5—and vice versa. The fully extracted position 26 corresponds to a first active position in which the setting and fixing device 23 establishes a rigid connection between the retaining plate 12 and base plate 11 in all spatial directions by means of the slide elements 24, 25. The fully or maximum retracted position 27*b* of the slide elements 24, 25 corresponds to a totally inactive operating mode of the setting and fixing device 23 in which the base plate 11 can be lifted off the retaining plate 12 in the direction perpendicular to the top face 13 of the snowboard 4 and in which operating mode the angle of rotation 20 can preferably be changed. In particular, when the slide elements 24, 25 are in the fully or maximum retracted position 27*b* and the setting and fixing device 23 is in the inactive position, the base plate 11 together with the components disposed on it can be lifted off the retaining plate 12 and off the snowboard 4 and removed.

The essential aspect of this is that on assuming the partially retracted position 27*a*, in particular on assuming a defined intermediate position between the two extreme positions 26 and 27*b*, the slide elements 24, 25 permit a rotating movement of the base plate 11 relative to the retaining plate 12, but removal or lifting of the base plate 11 from the snowboard 4 or from the retaining plate 12 is prevented.

Figure 3:
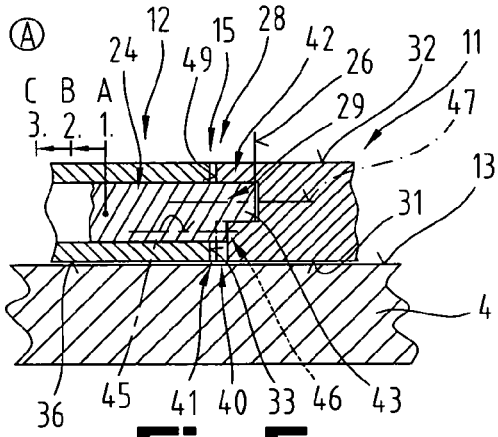
FIG. 3 shows a cross-section through the retaining plate illustrated in FIG. 2 on assuming the first operating mode.

As also clearly illustrated, the first group of slide elements 24 bridge or span a transition portion 28 between the retaining plate 12 and base plate 11 when in their maximum extracted position 26 relative to the retaining plate 12—FIG. 3. In particular, the slide elements 24 in their extracted position 26 define a positive connection to the base plate 11 and they overlap the base plate 11 in the peripheral portion around the circular orifice 15, at least in certain portions. Instead of the slide elements 24 positively overlapping in a peripheral portion around the orifice 15 of the base plate 11, it would also be possible, as illustrated by way of example, to provide at least one groove in the surface 49 of the orifice 15, in which end portions 29 of the slide elements 24 are able to locate in a positive fit and largely without any clearance. Toothed end portions 30 of the second group of slide elements 25 locate in matching toothing on the surface 49 of the orifice 15 in the base plate 11 when the slide elements 25 assume the maximum extracted position 26.

Especially if opting for the design based on a groove in the surface 49, it is not absolutely necessary for the base plate 11 to have an orifice 15 extending end to end from its bottom face 31 through to its top face 32 and instead, it would naturally also be possible to provide an adequate cut-out or recess in the bottom face 31. The top face 32 of the base plate 11 may therefore be designed continuously or flat in large areas.

On assuming the position 27*b* retracted fully or to a maximum in the retaining plate 12, the two pairs of slide elements 24, 25 lie outside the transition portions 28 between the retaining plate 12 and base plate 11. In other words, the slide elements 24, 25 are retracted into the retaining plate 12 and do not therefore overlap or span the transition portion 28. Consequently, the base plate 11 can be effortlessly removed from the retaining plate 12, which is secured on the snowboard 4 at least so that it is prevented from lifting.

Figure 2:
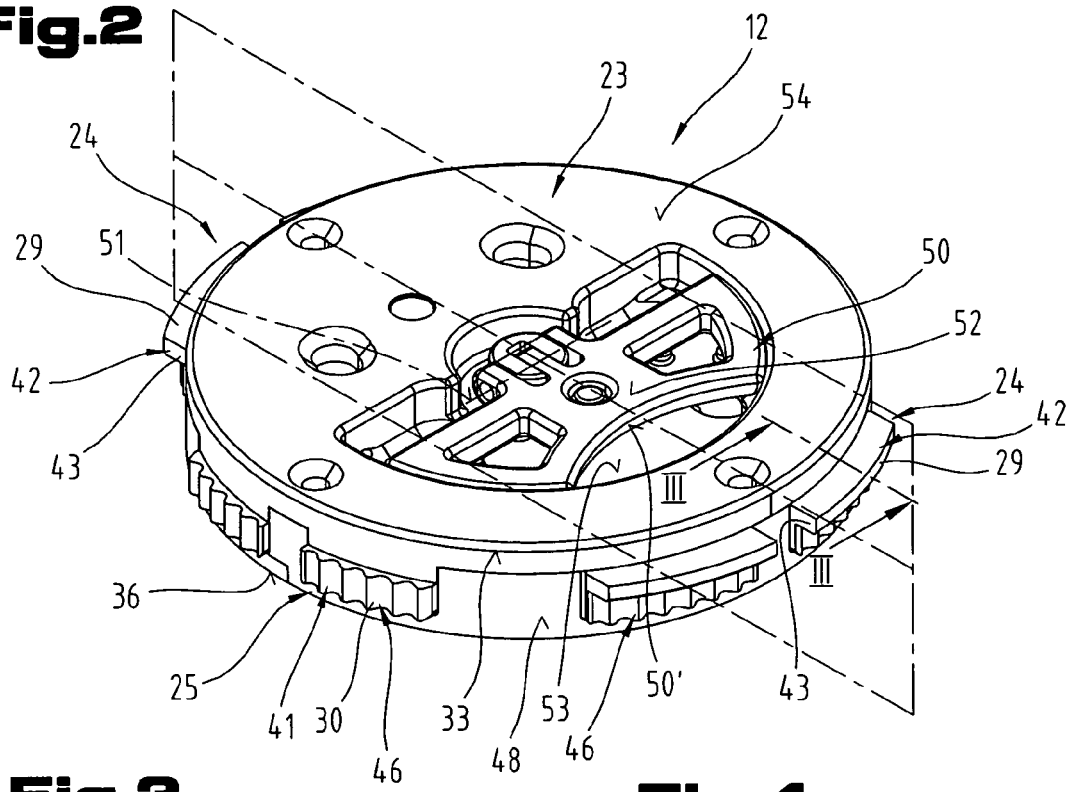
FIG. 2 is a perspective view from above illustrating an example of an embodiment of a retaining plate with three selectively activatable operating modes for a rigid retaining action, a rotating retaining action and to enable the base plate of a snowboard binding to be fitted and detached.

It is of particular practical advantage if all the slide elements 24, 25 are retained outside the retaining plate 12 and are mounted so that they are able to move relative to it so that they project out or extend out beyond a circular circumferential portion 33 of the retaining plate 12 in the maximum extracted position 26—FIG. 2, 3. In the partially extracted position 27*a*—FIG. 4—only the first group of slide elements 24 extends beyond the circular circumferential portion 33 of the retaining plate 12.

By contrast, the end portions 29, 30 of both types of slide elements 24, 25 are positioned inside the circular circumferential portion 33 of the retaining plate 12 and/or are oriented more or less flush with the surface 48 or circumferential portion 33 of the retaining plate 12 in the maximum or fully retracted position 27*b* so that there is no mutual overlap or crossover and there is no longer a positive connection between the retaining plate 12 and base plate 11 preventing vertical movements, which means that the base plate 11 can be lifted and removed from the snowboard 4.

In principle, it would be conceivable to operate or move two slide elements 24, 25 lying diametrically opposite one another or—as schematically illustrated—four of them forming a quadrant of the retaining plate 12 individually or separately from one another. Alternatively, it would also be possible to provide three or five slide elements 23, 24 or only a single slide element 24 in conjunction with immobile, preferably oppositely lying retaining projections. By preference, however, the binding mechanism 1, in particular the retaining plate 12, has a displacing mechanism 34—FIG. 6—by means of which several, usually all of the slide elements 24, 25, can be displaced in a coupled arrangement. It is preferable to provide a displacing mechanism 34 which permits a synchronous displacement of the slide elements 24, 25 in different and in mutually opposite directions, as may primarily be seen from FIG. 6.

This displacing mechanism 34 may be provided in the form of a gear or pinion 35 disposed at the centre of the retaining plate 12, which establishes a meshing drive connection to the slide elements 24, 25. In particular, the pinion 35 is mounted so as to rotate about an axis 37 extending through the centre of the retaining plate 12 and oriented perpendicular to its bottom face 36. The pinion 35 is provided in the form of a toothed gear. Toothed portions 38, 39 of the slide elements 24, 25 mesh with points of the pinion 35 distributed around the circumference. These portions 38, 39 therefore act as toothed racks, as it were, which extend at a tangent to the pinion 35 and locate with it in a positive or meshing fit. The slide elements 24, 25 and the toothed-rack type portions 38, 39 are provided in the form of integral, plate-type parts made from metal or plastic.

It would also be possible for the slide elements 24, 25 with the toothed portions 38, 39 adjoining them to be provided in the form of an assembled component made from metal and plastic, in particular from aluminum or steel with elements of hard plastic injected onto them.

Especially if two or four slide elements 24, 25 are provided, they are preferably displaceable in the radial direction with respect to the retaining plate 12. Another option would be for the slide elements 24, 25 to be displaced in other or combined directions of movement relative to the retaining plate 12.

Instead of the design based on a meshing connection between a pinion 35 and the slide elements 24, 25, it would naturally also be possible to obtain the same transmission forces using a friction coupling between a central friction gear and the slide elements 24, 25.

The binding mechanism 1, in particular the retaining plate 12, may optionally have at least one resilient means, by means of which the slide elements 24, 25 are continuously forced into the maximum extracted position 26. This at least one resilient means might be resilient lugs on the slide elements 24, 25 and on the retaining plate 12. By preference, the resilient means are provided in the form of at least one helical spring, in particular cylindrical compression springs.

The setting and fixing device 23 also has lock toothing 40 between the retaining plate 12 and base plate 11. This activatable and deactivatable lock toothing 40 primarily serves as a means of securing and very firmly fixing the selectably adjustable and fixable positions of angular rotation or angles of rotation 20 between the retaining plate 12 and base plate 11. Compared with a friction coupling, such lock toothing 40 offers a very strong anti-rotation lock 41 between the circular retaining plate 12 and base plate 11. The lock toothing 40 and the anti-rotation lock 41 locks the actual pivot bearing 16 between the retaining plate 12 and base plate 11 in the active state.

The setting and fixing device 23 also has an anti-lift lock 42 which can be activated and deactivated as and when necessary. This anti-lift lock 42 is preferably provided in the form of at least one strip-shaped projection or a retaining projection 43 on the slide elements 24, 25, in particular on the first group of slide elements 24. In particular, at least one retaining projection 43—in the example of an embodiment illustrated there are respectively two arcuately curved retaining projections 43—on the end portion 29 of the slide elements 24 facing away from the pinion 35. In the maximum extracted position 26, the at least one retaining projection 43 on the slide elements 24 prevents the base plate 11 from lifting or detaching from the retaining plate 12 screwed fixedly to the snowboard 4.

Figure 4:
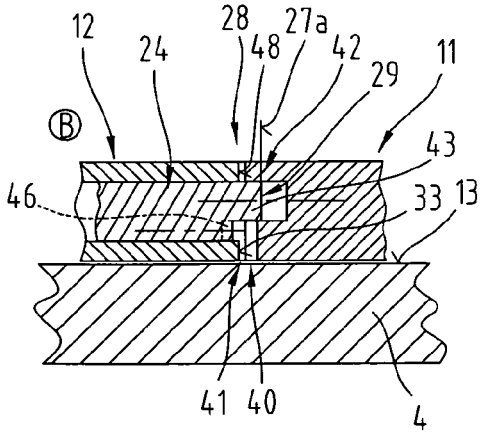
FIG. 4 shows a cross-section through the retaining plate illustrated in FIG. 2 on assuming the second operating mode.
Figure 5:
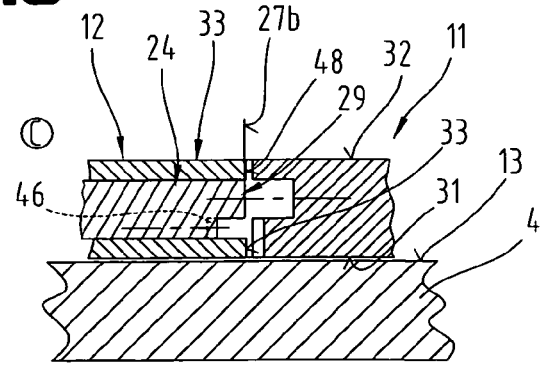
FIG. 5 shows a cross-section through the retaining plate illustrated in FIG. 2 on assuming the third operating mode.

The essential aspect is that the setting and fixing device 23 is designed so that it can be switched into at least three selectable operating modes A, B or C, as illustrated by way of example in FIGS. 3 to 5. The setting and fixing device 23 is designed so that on assuming the first operating mode A—FIG. 3—the anti-rotation lock 41 and the anti-lift lock 42 are active, which means that as rigid as possible and non-flexible a connection is established between the retaining plate 12 and base plate 11. In the second operating mode B of the setting and fixing device 23—FIG. 4—only the anti-rotation lock 41 is switched to an inactive state and the anti-lift lock 42 remains active so that although the base plate 11 can be turned relative to the retaining plate 12, the base plate 11 is prevented from being lifted off or removed from the retaining plate 12 and snowboard 4. In the third operating mode C—FIG. 5—of the setting and fixing device 23, both the anti-rotation lock 41 and the anti-lift lock 42 are inactive so that in this third operating mode C, the base plate 11 can be at least removed from the snowboard 4 and from the retaining plate 12. In this third operating mode C, the anti-rotation lock 41 is preferably also inactive as well as the anti-lift lock 42 so that the base plate 11 can also be effectively turned relative to the retaining plate 12 in the third operating mode C.

When the setting and fixing device 23 is in the first operating mode A, the slide elements 24, 25 assume their maximum extracted position 26, as illustrated by way of example in FIGS. 2 and 3. In the second operating mode B of the setting and fixing device 23, the slide elements 24, 25, in particular the first group of slide elements 24, assume a middle position, in particular a position 27*a* partially retracted or partially pulled back into the retaining plate 12, as schematically illustrated in FIG. 4. Accordingly, the anti-lift lock 42 remains active, whilst the anti-rotation lock 41 is inactive. When the setting and fixing device 23 assumes the third operating mode C, the slide elements 24 assume more or less the position 27*b* illustrated by way of example in FIG. 5. When all the slide elements 24, 25 are in this maximum pulled-back or retracted position, the anti-rotation lock 41 and also the anti-lift lock 42 are inactive so that the base plate 11 is able to turn relative to the retaining plate 12 but above all can be lifted off and removed from it.

The three operating modes A, B, C of the setting and fixing device 23 can therefore be set or adjusted by a user of the binding mechanism 1 or an employee of a hire shop without the need for separate tools, such as screwdrivers for example. In particular, the setting and fixing device 23 has three setting options which can be selected as required, which are clearly obvious to a user of the retaining plate 12 and binding mechanism 1 and can be easily activated.

It may be preferable if the setting and fixing device 23 dwells at least temporarily in each of its three operating modes A, B, C. In particular, the three operating modes A, B, C define a series of switching states which can be selectively chosen and which are maintained on a permanent basis without the need to intervene with manual retaining forces. In other words, it is not necessary for a user of the binding mechanism 1 or setting and fixing device 23 to hold the respective operating mode A, B, C by continuing to apply pressure to the setting and fixing device 23. These operating modes A, B, C therefore correspond to optionally selectable operating positions of the retaining plate 12 which are maintained until a user operates or adjusts the setting and fixing device 23 again. To this end, the setting and fixing device 23 is provided with a catch mechanism, which might comprise a spring-biased catch lug of a type known per se.

Via the pinion 35 and the toothed portions 38, 39 of the slide elements 24, 25, the setting and fixing device 23 serves as an actuator drive 44 which acts on both the anti-rotation lock 41 and the anti-lift lock 42. In other words, a common actuator drive 44 is provided, which is coupled in displacement with the anti-rotation lock 41 and also with the anti-lift lock 42. In particular, the actuator drive 44 for the slide elements 24, 25 is designed so that although it acts simultaneously on the anti-rotation lock 41 and on the anti-lift lock 42, deactivation of the anti-rotation lock 41 and deactivation of the anti-lift lock 42 take place at different times, in particular in advance of one another or lagging behind one another. Specifically, when the setting and fixing device 23 is switched from operating mode A—FIG. 3—to operating mode C—FIG. 5—the anti-rotation lock 41 is deactivated first (on assuming operating mode B) and only after this is the anti-lift lock 42 also deactivated (on assuming operating mode C). When switching from operating mode C to operating mode A, on the other hand, it is the anti-lift lock 42 which is activated first of all (on assuming operating mode B), after which the anti-rotation lock 41 is also activated (on assuming operating mode A). This offset in time or this premature or delayed timing therefore depends on whether a change is being made from operating mode A, B, C or C, B, A.

The setting and fixing device 23 is therefore designed so that it can be switched from one of its three operating modes A, B, C exclusively into an immediately adjacent operating mode, in particular the next one higher and/or next one lower. In particular, the setting and fixing device 23 can be switched from A to B and from B to C, from C to B and from B to A. It is also possible to undertake a multiple mode change between two "adjacent" operating modes A, B respectively B, C.

This means that the setting and fixing device 23 can be switched without the aid of tools from the first operating mode A into the second operating mode B and then into the third operating mode C, and from the third operating mode C into the second operating mode B and then into the first operating mode A.

By virtue of one advantageous embodiment, the setting and fixing device 23 has at least one slide element 24, 25, which has toothing 46 serving as a part-component of the anti-rotation lock 41 in a first, bottom plane 45. This toothing 46 is provided in the form of straight tooting which can be moved in and out via the slide elements 24, 25 in the radial direction with respect to the centre point of the circular retaining plate 12. In particular, the toothing 46 can be variably positioned relative to the base plate 11 due to its design at the outer end portions 29, 30 of the slide elements 24, 25.

Disposed in the end portions 29 facing away from the centre of the retaining plate 12 in a plane 47 lying in the vertical direction above the toothing 46, the slide elements 24 are of a first type or design acting as the at least one retaining projection 43, which forms a part-component of the anti-lift lock 42. Accordingly, it is preferable if the toothing 46 for the anti-rotation lock 41 and the at least one retaining projection 43 for the anti-lift lock 42 are disposed in different planes 45, 47 in terms of their height, and the retaining projection 43 for the anti-lift lock 42 is preferably disposed in the plane 47 lying higher, relatively speaking. This being the case, a user can visually see and recognize the respective operating mode of the anti-lift lock 42 immediately, thereby increasing safety during use and maintaining a relatively high level of safety. This also results in a high resistance of the base plate 11 to breaking or tearing off the retaining plate 12, especially at the peripheral portions around the orifice 15.

Alternatively, it is also possible for the setting and fixing device 23 to have at least one slide element 24, 25 which is provided at its terminal end facing away from the centre of the retaining plate 12 with a retaining projection 43 for retaining the base plate 11 in a positive fit, in which case this retaining projection 43 is also provided with toothing 46 to establish a reliable anti-rotation lock 41. In particular, it would be conceivable for the end portion 29, 30 facing away from the centre of the retaining plate 12 to be provided with at least one slide element 24, 25 with toothing 46 and to provide a slide element 24, 25 acting as a retaining projection 43 in the portion immediately adjoining the centre point of the retaining plate 12. Depending on the position of the slide element 24, 25, it is then possible to selectively activate and deactivate the anti-rotation lock 41 and the anti-lift lock 42 at different times.

The wheel-type retaining plate 12 has a surface 48 with at least some portions that are cylindrical or frustoconical. If opting for a frustoconical design of the retaining plate 12, the base surface of the conical body is always the bottom face 36 of the retaining plate 12. The surface 48 of the retaining plate 12 in co-operation with corresponding guide surfaces on the surface 49 of the orifice 15 in the base plate 11 constitutes the pivot bearing 16 for the base plate 11 relative to the retaining plate 12. In this respect, it is sufficient if either the orifice 15 or the corresponding cut-out in the base plate 11 or the retaining plate 12 has circular or arcuate surfaces at least in some regions in order to act as the pivot bearing 16. For example, the retaining plate 12 could be a circular-type polygonal body as seen in plan view.

Another essential aspect is the fact that the retaining plate 12 has an approximately circular or conical boundary or surface 48 in operating mode C in which the slide elements 24, 25 are retracted to the maximum so that the end portions 29, 30 of the slide elements 24, 25 terminate approximately flush with the surface 48. In particular, the slide elements 24, 25 do not project out from the surface 48 or do so only marginally in operating mode C.

As explained above, the anti-rotation lock 41 and the anti-lift lock 42 are provided with a common actuator drive 44 coupling them in displacement in order to deactivate the anti-rotation lock 41 and anti-lift lock 42 synchronously in terms of time and function but shifted in phase. In particular, the anti-rotation lock 41 or the anti-rotation lock 41 and the anti-lift lock 42 can be activated and deactivated by means of the common, central actuator drive 44, which is preferably controllable and operable by only one handle 50. This being the case, the actuator drive 44 can be activated via the handle 50 so that the anti-lift lock 42 is activated in the first operating mode A and also in the second operating mode B and is inactive in the third operating mode C only.

The actuator drive 44 may cause any extraction and retraction movements of the slide elements 24, 25. In particular, the slide elements 24, 25 are mounted so that they can be displaced in translation or rotation and are moved in the radial or tangential direction relative to the retaining plate 12.

The toothing 46 on the slide elements 24 and/or 25 and the lock toothing 40 on the base plate 11 co-operating with it, these sets of teeth each being provided in the form of straight teeth so that their teeth extend axially parallel with the axis 37 of the pinion 35 and the axis 37 of the disc-shaped or wheel-shaped retaining plate 12, constitute an anti-rotation lock 41 between the retaining plate 12 and base plate 11 which is particularly functionally reliable and is capable of withstanding high rotating forces or torque values. The lock toothing 40 preferably extends around the orifice 15 in the base plate 11. In particular, the lock toothing 40 is provided on part-portions of the surface 49 of the cylindrical and optionally stepped orifice 15. In their maximum extracted position, at least the slide elements 24 based on the first type act as the anti-lift lock 42 for the base plate 11 relative to the retaining plate 12 in directions extending perpendicular to the standing plane 19. The setting and fixing device 23 between the retaining plate 12 and base plate 11 therefore comprises the anti-rotation lock 41 on the one hand and the anti-lift lock 42 on the other hand.

From the explanations given above and the schematic diagrams, it is clear that, the slide elements 24, 25 of the setting and fixing device 23, depending on their relative position with respect to the retaining plate 12 and with respect to the base plate 11, act as (i) the anti-lift lock 42 and anti-rotation lock 41 in operating mode A, as (ii) the anti-lift lock 42 when the anti-rotation lock 41 is inactive in operating mode B or as (iii) an inactive anti-rotation lock 41 and inactive anti-lift lock 42 in operating mode C.

The respective operating mode A, B or C of the setting and fixing device 23, in particular the respective actuator position of the slide elements 24, 25, can be changed manually by means of the handle 50 and without the need for additional tools. This being the case, the handle 50 acts on the pinion 35 to permit a two-directional rotation of the pinion 35 about its axis 37.

Figure 6:
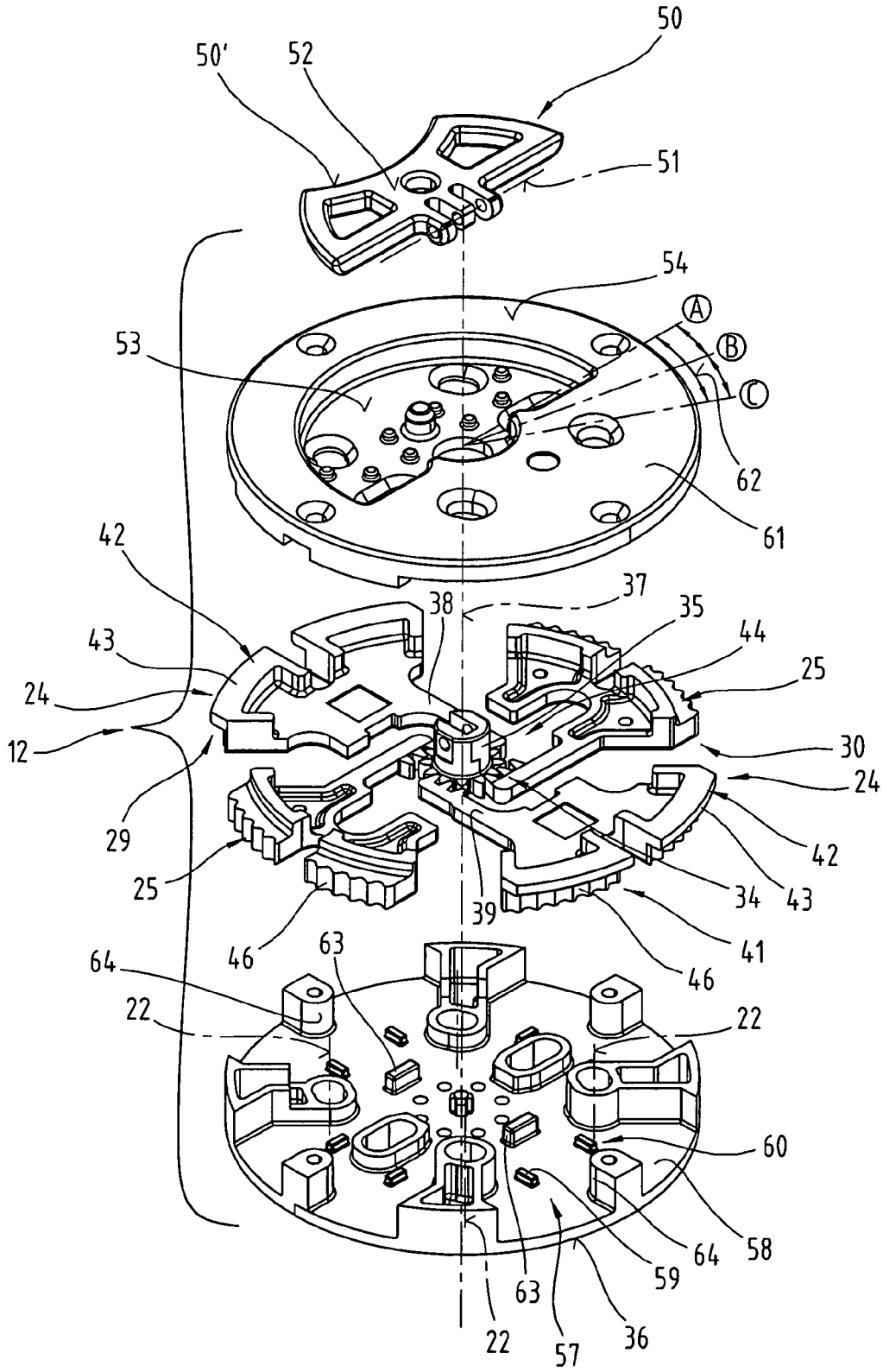
FIG. 6 is an exploded diagram of the retaining plate illustrated in FIG. 2.

Based on a preferred embodiment, the handle 50 is mounted so that it can be pivoted or tilted about a pivot axis 51 extending transversely to the axis 37 of the pinion 35, as schematically illustrated in FIG. 6. In this respect, the handle 50 has a defined locking position 52 in which any rotating movement of the pinion 35 and hence any translating movement of the slide elements 24, 25 is prevented or locked. This locking position 52 is defined by a largely flat or horizontally lying position of the strip-type or plate-type handle 50. On assuming the locking position 52, therefore, the top and bottom flat face of the handle 50 is disposed essentially parallel with a top face 54 of the retaining plate 12. The pivot axis 51 of the handle 50 co-operates with a longitudinal side edge of the plate-type or strip-type handle 50. The handle 50 preferably has a half-moon-shaped or semicircular contour, as schematically illustrated in FIG. 6.

When the handle 50 assumes its locking position 52, it is preferably fixed in a recess 53 in the top face 54 of the retaining plate 12 so that it can not turn. The contour of the recess 53 in the top face 54 of the retaining plate 12 therefore corresponds at least partially to a contour of the handle 50 in its position lying flat, as illustrated by way of example in FIG. 6. The contours of the recess 53 and the handle 50 match one another so that the handle 50 can be embedded inside the recess 53 in a positive fit when the position of angular rotation and the orientation between the recess 53 and the handle 50 are essentially congruent, as illustrated by way of example in FIGS. 2 and 6. Pivoting the handle 50 about the pivot axis 51 therefore enables either a locking position 52 or an operating position to be assumed. When it assumes the operating position, the strip-type or plate-type handle 50 is essentially vertically oriented. A pivot angle between the locking position 52 and the operating position of the handle 50 is approximately 90°. In the upwardly pivoted operating position, a reliable and ergonomic grip of the handle 50 is possible, thereby permitting easy operation of the setting and fixing device 23.

The essential aspect is that the recess 53 and the handle 50, which can be moved so that it is more or less congruent with it, are designed and positioned relative to one another so that the handle 50 can not be moved into the downwardly pivoted, flat-lying locking position 52 unless the setting and fixing device 23 has assumed the first operating mode A, i.e. is in a state in which the anti-rotation lock 41 and also the anti-lift lock 42 are activated.

An indentation 50', an orifice or a lateral notch in the handle 50 serves as a means of more readily engaging the handle 50 in the situation where a user pivots the handle 50 up from the locking position 52 into the upwardly pivoted operating position. In particular, the handle 50 can be pivoted up from the locking position 52 lying in the recess 53 into the upwardly pivoted operating position relatively easily, even if wearing gloves, due to a lateral indentation 50' in the handle 50 disposed on the longitudinal side or side edge of the handle 50 lying opposite the pivot axis 51.

In the locking position 52, the top flat face of the handle 50 terminates flush or more or less flush with the top face 54 of the retaining plate 12 so that it is possible to step into the binding mechanism 1 unhindered with a corresponding sports shoe 3, which often has a sole without a heel or a sole which is relatively flat. By contrast, it is not possible to step with a sports shoe 3, in particular a snowboard shoe 5, into and connect with a binding mechanism 1 which is not in a state fit for use if the handle 50 is in any position other than the locking position 52. In particular, it is more difficult or impossible to step into the binding mechanism 1 if the strip-type or plate-type handle 50 is in its upwardly pivoted or almost upright position and is therefore standing up in the vertical direction from the top face 54 of the retaining plate 12 in a pronounced manner. This design feature significantly improves the safety of the binding mechanism 1 during use.

Another essential aspect is the fact that the handle 50 and the recess 53 are designed and positioned relative to one another so that it is not until the handle 50 has assumed the flatly-lying locking position 52—operating mode A illustrated in FIG. 2—that the slide elements 24, 25 are extracted to the maximum, thereby guaranteeing an active anti-rotation lock 41 and an active anti-lift lock 42.

Furthermore and as best illustrated in FIG. 6, different types and in particular two different types of slide elements 24, 25 are provided, each with a view to fulfilling different purposes or functions. In the advantageous embodiment illustrated in FIG. 6, all of the slide elements 24, 25 assume and fulfill the function of an anti-rotation lock 41, whereas individual slide elements, in particular slide elements 24 based on the first type, can additionally assume and fulfill the function of the anti-lift lock 42. To this end, the two first slide elements 24 positioned diametrically with respect to the retaining plate 12 have at least one retaining projection 43 above the toothing 46, which extends out in the radial direction with respect to the retaining plate 12 beyond the toothing 46.

One particular feature of the binding mechanism 1 and retaining plate 12 proposed by the invention, amongst others, is that the retaining plate 12 can remain rigidly connected to the sports device 2 or snowboard 4 via the fixing screws 22 when changing the angle of rotation 20 in order to change the position of angular rotation or angle of rotation 20 of the base plate 11 relative to the sports device 2—FIG. 1. In particular, it is not necessary to loosen the fixing screws 22 for the retaining plate 12. The slide elements 24, 25 merely have to be moved into the slightly retracted position 27*a*—FIG. 4—to enable the base plate 11 to be adjusted relative to the retaining plate 12 depending on the desired angle of rotation 20, after which the anti-rotation lock 41 merely has to be activated again by moving the slide elements 24, 25 into the extracted position 26—FIG. 3.

In one advantageous embodiment, the retaining plate 12 is a unit which is already fitted to the sports device 2 or snowboard 4 at the factory or by the retailer. Prior to dispatching or selling or hiring the sports device 2, it is therefore only necessary to fit and lock an appropriate base plate 11 on the respective or desired coupling parts 6, 7—FIG. 1.

Furthermore, such a sports device 2 with the retaining plate 12 mounted on it can be stored in shelves or storage facilities in a particularly compact arrangement. Particularly in the case of facilities hiring out such sports devices 2 or snowboards 4, this unit comprising the snowboard 4 and retaining plate 12 can be supplied and rapidly and effortlessly connected to an appropriate base place 11 of the relevant size and/or design and/or strength with the requisite auxiliary elements fitted on it, as illustrated in FIG. 1. Accordingly, the base plate 11 may already be fitted with all the necessary auxiliary components—as illustrated by the detail shown in FIG. 1—and may also be already coupled with the co-operating sports shoe 3, in particular with the relevant snowboard shoe 4. It is particularly recommended that snowboard shoes 5 together with the associated base plate 11 and requisite auxiliary elements be stored jointly, thereby resulting in a particularly compact arrangement.

Amongst other things, these auxiliary elements include a so-called calf support, which is usually mounted on a retaining bracket or so-called "heel-loop" of the binding mechanism 1, as may be seen from FIG. 1. The primary purpose of this calf support is to enable the pressure exerted by the user on the sports device 2 in the heel region to be more sensitively applied. It is of no importance whether the retaining bracket is a separate element, as illustrated in FIG. 1, or is an integral unit with the base plate 11.

Figure 7:
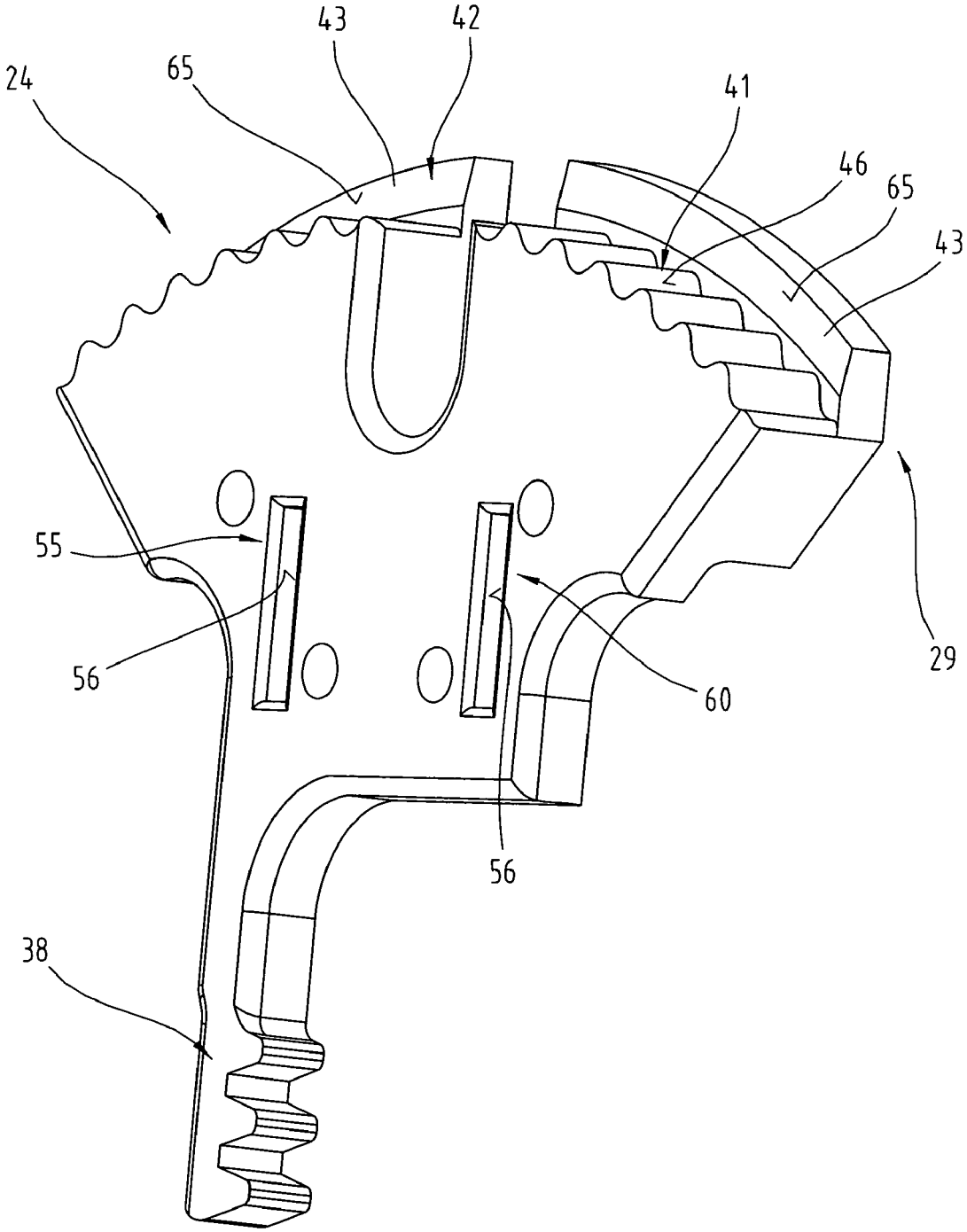
FIG. 7 is a perspective diagram showing an example of a slide element of the retaining plate for establishing the anti-rotation lock and the anti-lift lock.

FIG. 7 is a view from underneath, at an angle, illustrating one advantageous embodiment of the first type or design of slide elements, in particular the slide elements 24. From this, it is clear that the toothing 46 for the anti-rotation lock 41 extends in an arc or as a circle segment and/or circle sector of a gear. At least one retaining projection 43 projects out from this toothing 46 and fulfils the function of the anti-lift lock 42. The toothing 46 and the retaining projections 43 are an integral component and a relative displacement between the toothing 46 and the retaining projection 43 is therefore not possible. In particular, there is always a joint and totally identical relative displacement of the toothing 46 and the retaining projections 43 along the respective displacement direction or displacement path of the slide element 24.

The toothed or toothed-rack portion 38 which enters into a meshing engagement with the pinion 35—FIG. 6—is disposed in the end portion of the plate-shaped slide elements 24 facing away from the toothing 46 and away from the retaining projections 43.

It is preferable if at least one guide element 55 is provided on the bottom face of the slide element 24, for example a groove-type notch 56, which assists an exact guiding action and sliding action of the slide element 24 as intended. These guide elements 55 cooperate with corresponding guide elements 57 on a base plate 58—FIG. 6—of the retaining plate 12. In particular, strip-shaped raised areas 59 are disposed on the base plate 58, which can be moved in a sliding connection with the notches 56 on the bottom face of the slide elements 24 and/or 25, thereby forming a linear guide 60. This linear guide 60 is of particular advantage due to the fact that the toothed rack portion 38 acts eccentrically or asymmetrically with respect to the slide element 24. In spite of the fact that forces act eccentrically on the slide element 24, the slide element 24 and/or 25 is guided as lightly as possible and without jamming.

In addition to the circular disc-shaped base plate 58, the retaining plate 12 also has a circular disc-shaped top plate 61, preferably of an identical diameter. Disposed between the base plate 58 and the top plate 61 is a mounting space for the slide elements 24, 25 and pinion 35, as may best be seen from FIG. 6. Inside this mounting space, the slide elements 24, 25 and the pinion 35 are mounted so that they can effect the appropriate relative movements and the respective forces which occur can be absorbed.

As may best be seen from FIG. 6, the pinion 35 can be rotated within only a limited range of angular rotation 62. The start and end values of this range of angular rotation 62 respectively define the first operating mode A and the third operating mode C. The second operating mode B is defined between these start and end values of the full range of angular rotation 62. In this respect, it is of practical advantage if the range of angular rotation 62 of the pinion 35 is limited by a minimum stop 63 and a maximum stop 64 for at least one of the slide elements 24, 25 at the ends of the maximum displacement path of the slide elements 24, 25.

As may best be seen from FIGS. 6 and 7, an oblique surface 65 may be provided on at least the bottom face of the retaining projections 43, which is inclined at an angle towards the bottom face 31 and towards the top face 32 of the base plate 11. In particular, the end portions 29 of the slide elements 24 with the retaining projections 43 may be of a wedge-shaped design as viewed in cross-section. As a result, when the slide element 24 is extracted, a wedging action is generated, thereby resulting in an arrangement in which the base plate 11 is retained as far as possible without any clearance. The wedge shape of the outer end portions 29 of the slide elements 24 tapering outwards to a point offer an advantage in that even if the base plate 11 is not oriented or positioned absolutely exactly with respect to the retaining plate 12, the slide elements 24 can still be transferred reliably into the correct position. In particular, when pointed slide elements 24 in the end portions 29 are extracted, any positioning inaccuracies which might be caused by snow or ice between the base plate 11 and the top face 13 of the snowboard 4 are cancelled out or eliminated to a certain degree. In other words, a certain amount of self-adjustment can be achieved between the retaining plate 12 and base plate 11 due to the oblique surfaces 65. This further improves handling of the binding mechanism 1 in many situations which can arise in practice and in different environmental conditions and the intended handling by the user or operator is made faster.

Figure 8:
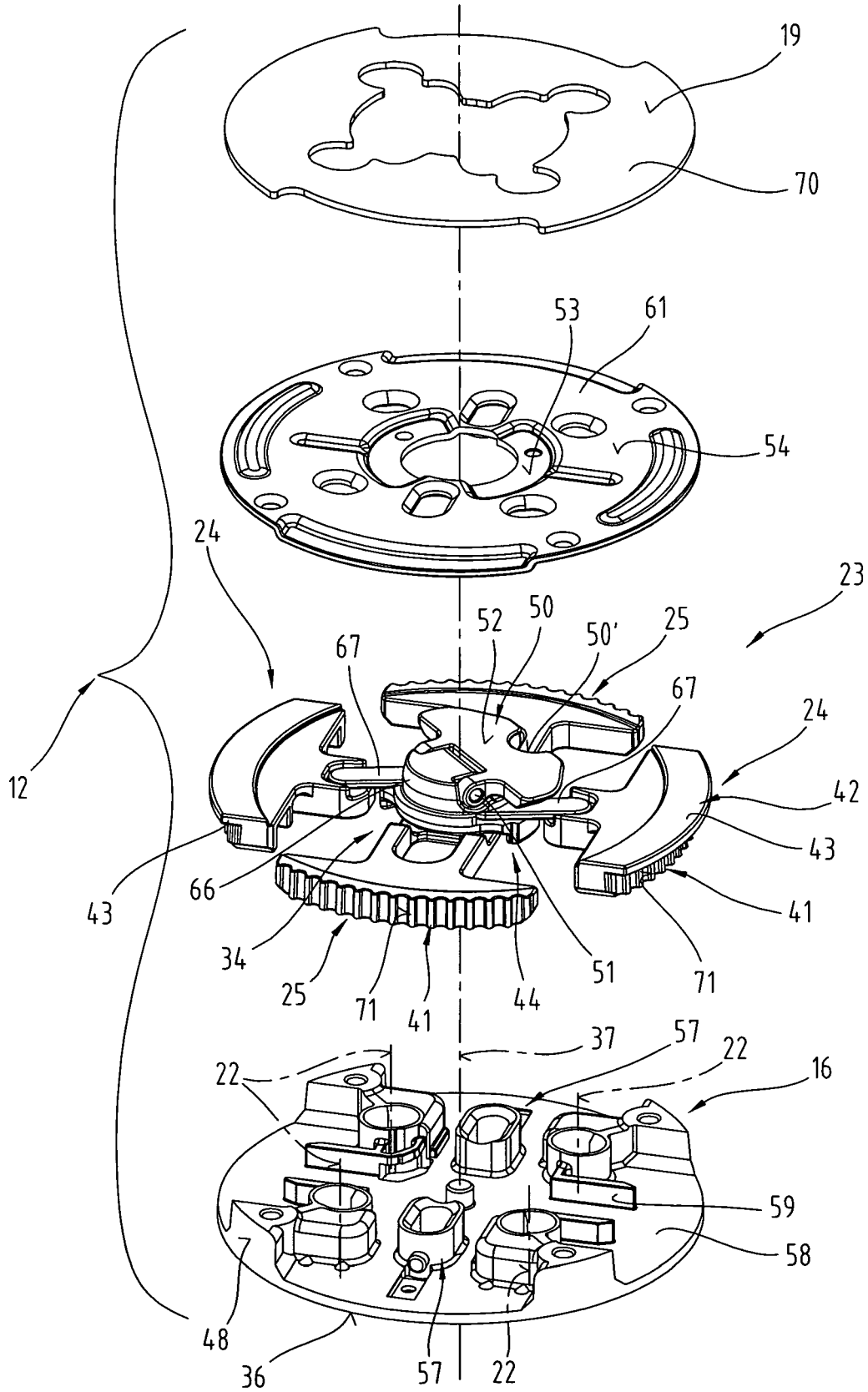
FIG. 8 is an exploded diagram taken from above at an angle showing another embodiment of a retaining plate for the base plate of a binding mechanism.
Figure 9:
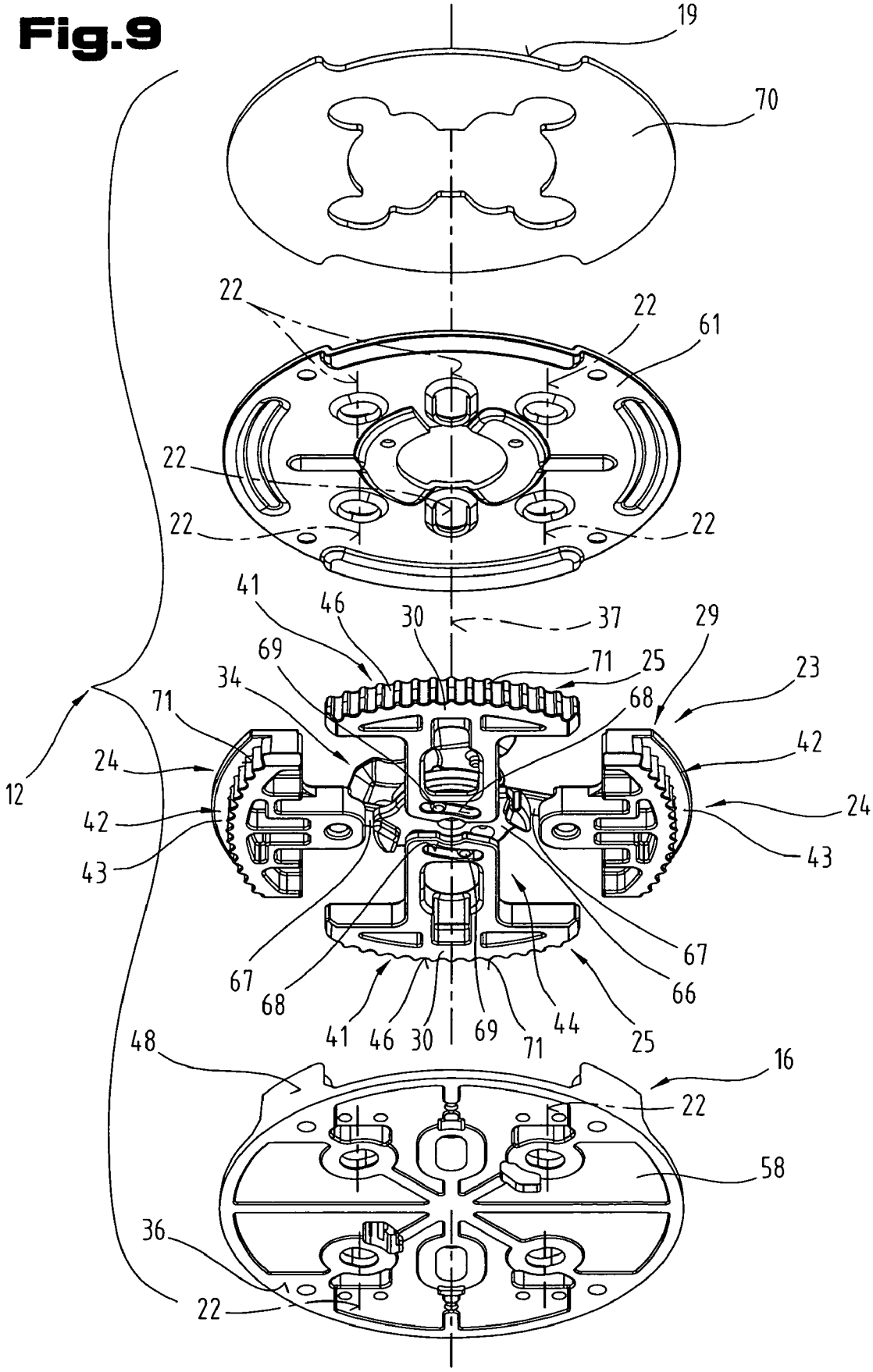
FIG. 9 is a perspective view taken at an angle from underneath showing the retaining plate illustrated in FIG. 8.

FIGS. 8 and 9 illustrate another embodiment of a retaining plate 12 for the base plate 11 of a binding mechanism 1—FIG. 1. The same reference numbers will be used to denote parts already described above and the descriptions given above may be applied literally to parts denoted by the same reference numbers.

This retaining plate 12, the main components of which are illustrated in an exploded diagram, has a central actuator drive 44 for the slide elements 24, 25, and this actuator drive 44 couples a pair of slide elements 24 and a pair of slide elements 25 via what are technically different drive mechanisms.

This actuator drive 44, which is part of the setting and fixing device 23, has a rotatably mounted coupling disc 66, mounted so that it is able to rotate about an axis 37 extending through the centre of the retaining plate 12. This coupling disc 66 is articulatingly linked by at least one of its circumferential portions to at least one coupling or connecting rod 67. The corresponding articulation axis extends parallel with the axis 37. The end of the connecting rod 67 facing away from the coupling rod 66 is coupled with the slide element 24 via another articulated link. In particular, a connecting rod-coupling is provided between the coupling disc 66 and at least one slide element 24, and the articulation axes in the end portions of the connecting rod 67 extend parallel with the axis 37. Accordingly, a rotating movement of the coupling disc 67 about the axis 37 is converted into a linear displacement of the slide element 24 via these connecting rods 67.

The two first slide elements 24 disposed diametrically opposite one another, which also serve as the anti-lift lock 42, are preferably each coupled in displacement via a respective connecting rod 67 with the centrally positioned, rotatably mounted coupling disc 66. The coupling disc 66 is preferably able to rotate in two directions but only within a limited range of angular rotation 62—FIG. 6—of less than 360°. It is therefore not necessary for the coupling disc 66 to rotate infinitely in order to achieve the adjustment distances needed for the slide elements 24.

The other pair of slide elements 25 of what are in total four slide elements 24, 25 on the retaining plate 12 is coupled in displacement with the central coupling disc 66 via a slide guide 68. In particular, the setting and fixing device 23 has another, technically different type of coupling mechanism, whereby the rotatably mounted coupling disc 66 is connected to at least one other slide element 25 by means of at least one slide guide 68 and by means of a guide block 69 guided in it. In particular, each slide element 25 has a respective slide guide 68 and a respective guide block 69 in order to establish a coupled displacement between the coupling disc 66 and slide element 25. By preference, two slide elements 25 disposed diametrically opposite one another and radially displaceable with respect to the retaining plate 12 are coupled with the central coupling disc 66 in displacement by means of slide guides 68 and guide blocks 69.

The slide guide 68, which is preferably disposed on or in the slide elements 25, is preferably of an arcuately curved design. The slide guide 68 is preferably made up of several different radii and the slide guide 68 has a varying pitch relative to the desired actuation direction of the slide elements 25. As a result, varying or different adjustment distances or step widths can be set for the slide elements 25 within identical or constant steps of angular rotation or setting widths of the setting and fixing device 23, in particular the coupling disc 66. This means that within the total range of angular rotation of the coupling disc 66, varying adjustment distances or actuator speeds can be set for the slide elements, even though the coupling disc 66 travels identical or constant steps of angular of rotation. This enables an optimum distance/force ratio to be obtained for the setting and fixing device 23 during switching between the respective operating modes A, B, C—FIG. 6.

Based on the embodiment illustrated in FIGS. 8, 9, therefore, there is a total of four slide elements 24, 25 distributed around the circumferential region of the retaining plate 12, and a first pair of slide elements 24 is coupled in displacement with the central actuator drive 44, each via a connecting rod 67, and the second pair of slide elements 25 is coupled in displacement with the common actuator drive 44, in particular with the rotatably mounted coupling disc 66, each via a slide guide 68.

The advantage of this combination of two technically different drive mechanisms is that it strikes an ideal compromise between the limited space available for the slide elements 24, 25 inside the retaining plate 12 and between sufficient strength or stability of the respective guides and slide elements 24, 25. Furthermore, this combination of two different drive mechanisms for a total of four slide elements 24, 25 means that the retaining plate 12 can be more easily be provided with a plurality of bores, in particular at least six bores, by means of which the retaining plate 12 can be screwed fixedly or rigidly by means of fixing screws 22 to the top face 13 of a gliding board body—FIG. 1. As a result, the retaining plate 12 can be supplied for fitting on snowboards with different mounting interfaces. In particular, a total of six boreholes or orifices may be provided on the retaining plate 12, but by using the two different types of drive for the slide elements 24, 25 it is still possible to obtain sufficient strength and robustness of the retaining plate 12 and slide elements 24, 25. In particular, the slide guides 68 make for relatively compact or space-optimized driving kinematics to enable the slide elements 25 to be extracted and retracted as and when required. By contrast, the drive concept based on the connecting rods 67 for the slide elements 24 requires more space and more room for maneuver, relatively speaking. With this drive mechanism, however, the setting and fixing device 23 can be easily and reliably locked when the slide elements 24, 25 are in the maximum extracted position, in particular on assuming operating mode A, in other words the locking position—FIG. 3.

By preference, the top face of the top plate 61 is at least partially provided with a covering layer 70 made from a soft elastic or elastomeric material. This covering layer 70 increases the slip-resistance of a sports or snowboard shoe 5 supported on the retaining plate 12, as illustrated by way of example in FIG. 1.

Again with this embodiment of the retaining plate 12, therefore, a setting and fixing device 23 is provided which has at least one slide element 24, 25 displaceably mounted on the retaining plate 12, which has toothing 46 at its end portion 30 facing away from the center of the retaining plate 12 serving as a part-component of the anti-rotation lock 41. This toothing 46 can be selectively engaged with and disengaged from lock toothing 40 around the orifice 15 in the base plate 11—FIG. 3 to FIG. 5—depending on the operating mode A, B or C of the setting and fixing device 23. Again, the lock toothing 40 of the base plate 11—FIG. 3 to FIG. 5—and the toothing 46 at the terminal end 30 of the at least one slide element 24, 25 co-operating with it has tooth flanks 71 extending perpendicular to the standing plane 19—FIG. 1. Due to a relative displacement of the at least one slide element 24, 25 in the radial direction with respect to the retaining plate 12, these tooth flanks 71 extending perpendicular to the standing plane 19 can be selectively moved into and out of engagement with respect to the lock toothing 40 on the base plate 11—FIG. 3 to FIG. 5. In particular, the anti-rotation lock 42 can be activated and deactivated by displacing the slide elements 24, 25 horizontally, in which case the anti-rotation lock 41 is deactivated when the slide elements 24, 25 are in the partially or fully retracted position 27*a* or 27*b*—FIG. 4, 5—and the anti-rotation lock 41 is active when the slide elements 24, 25 are in the maximum extracted position—operating mode A illustrated in FIG. 3.

The setting and fixing device 23 is designed so that the tooth flanks 71 of the at least one slide element 24, 25 terminate at least flush with the surface 48 of the retaining plate 12 or is positioned set back from the surface 48 of the retaining plate 12 in the direction towards the center of the retaining plate 12 on assuming the second operating mode B—FIG. 4. In this operating mode B, the base plate 11—FIG. 4—is able to turn relative to the retaining plate 12, which continues to be rigidly secured to and immobilized on the top face 13 of a gliding board body. The essential aspect of this is that in this second operating mode B in which the anti-rotation lock 41 is deactivated, the anti-lift lock 42 remains active and a vertical relative displacement between the retaining plate 12 and base plate 11 is not necessary and is not possible. As a result, especially when changing the position of angular rotation of the base plate 11 on the piste or during use, snow is not able to collect underneath the base plate 11, thereby preventing any impairment to the function and safety of the binding mechanism 1 as would otherwise occur. In particular, the base plate 11 and retaining plate 12 always remain in as full a surface contact as possible with the top face 13 of a gliding board body, in particular a snowboard 4—FIG. 1—when a change in the position of angular rotation of the base plate 11 is made or desired on assuming the second operating mode B.

In particular, the setting and fixing device 23 is designed so that on assuming the second operating mode B—FIG. 4—the pivot bearing 16 between the retaining plate 12 and base plate 11 is released so that the base plate 11 is able to rotate relative to the retaining plate 12 within the horizontally extending standing plane 19—FIG. 1. A displacement of the base plate 11 in the vertical direction relative to the standing plane 19 or in the vertical direction relative to the retaining plate 12 nevertheless is prevented at least approximately free of clearance because the anti-lift lock 42 remains active and prevents the base plate 11 from lifting off the top face 13 of a gliding board body.

The embodiments illustrated as examples represent possible variants of the binding mechanism 1 and retaining plate 12 and it should be pointed out at this stage that the invention is not specifically limited to the variants specifically illustrated, and instead the individual variants may be used in different combinations with one another and these possible variations lie within the reach of the person skilled in this technical field given the disclosed technical teaching. Accordingly, all conceivable variants which can be obtained by combining individual details of the variants described and illustrated are possible and fall within the scope of the invention.

For the sake of good order, finally, it should be pointed out that, in order to provide a clearer understanding of the structure of the binding mechanism 1 and retaining plate 12, they and their constituent parts are illustrated to a certain extent out of scale and/or on an enlarged scale and/or on a reduced scale.

Above all, the individual embodiments of the subject matter illustrated in FIGS. 1; 2; 3, 4, 5; 6; 7; 8, 9 constitute independent solutions proposed by the invention in their own right. The objectives and associated solutions proposed by the invention may be found in the detailed descriptions of these drawings.

LIST OF REFERENCE NUMBERS

| | |
|---|---|
| 1 | Binding mechanism |
| 2 | Sports device |
| 3 | Sports shoe |
| 4 | Snowboard |
| 5 | Snowboard shoe |
| 6 | Coupling part |
| 7 | Coupling part |
| 8 | Coupling part |
| 9 | Coupling part |
| 10 | Catch coupling |
| 11 | Base plate |
| 12 | Retaining plate |
| 13 | Top face |
| 14 | Diameter |
| 15 | Orifice |
| 16 | Pivot bearing |
| 17 | Axis |
| 18 | Binding longitudinal axis |
| 19 | Standing plane |
| 20 | Angle of rotation |
| 21 | Longitudinal axis |
| 22 | Fixing screw |
| 23 | Setting and fixing device |
| 24 | Slide element |
| 25 | Slide element |
| 26 | Maximum extracted position |
| 27a | Partially retracted position |
| 27b | Retracted position |
| 28 | Transition portion |
| 29 | End portion |
| 30 | End portion |
| 31 | Bottom face |
| 32 | Top face |
| 33 | Circumferential portion |
| 34 | Displacing mechanism |
| 35 | Pinion |
| 36 | Bottom face |
| 37 | Axis |
| 38 | Portion (toothed) |
| 39 | Portion (toothed) |
| 40 | Lock toothing |
| 41 | Anti-rotation lock |
| 42 | Anti-lift lock |
| 43 | Retaining projection |
| 44 | Actuator drive |
| 45 | Plane (bottom) |
| 46 | Toothing |
| 47 | Plane (top) |
| 48 | Surface |
| 49 | Surface |
| 50 | Handle |
| 50' | Indentation |
| 51 | Pivot axis |
| 52 | Locking position |
| 53 | Recess |
| 54 | Top face |
| 55 | Guide element |
| 56 | Notch (groove-type) |
| 57 | Guide element |
| 58 | Base plate |
| 59 | Raised area (strip-shaped) |
| 60 | Linear guide |
| 61 | Top plate |
| 62 | Range of angular rotation |
| 63 | Minimum stop |
| 64 | Maximum stop |
| 65 | Oblique surface |

-continued

| LIST OF REFERENCE NUMBERS | |
|---|---|
| 66 | Coupling disc |
| 67 | Connecting rod |
| 68 | Slide guide |
| 69 | Guide block |
| 70 | Covering layer |
| 71 | Tooth flank |

The invention claimed is:

1. Binding mechanism (1) for a snowboard binding, provided with what is an essentially circular retaining plate (12) for a base plate (11) as seen in plan view for securing it to a gliding board body with coupling parts (6, 7) mounted directly or indirectly on it for providing a releasable connection to a sports shoe (3) as and when necessary, shoe (5), with an anti-lift lock (42) which can be selectively activated and deactivated as and when necessary to prevent and permit lifting movements of the base plate (11) relative to the retaining plate (12), with an anti-rotation lock (41) which can be activated and deactivated as and when necessary in order to individually pre-set an angle of rotation (20) between the base plate (11) and retaining plate (12) by reference to a plane extending parallel with a standing plane (19) on the base plate (11), and with a setting and fixing device (23) which can be operated without tools for at least activating and deactivating the anti-lift lock (42) between the retaining plate (12) and base plate (11) as and when necessary, wherein a setting and fixing device (23) is provided which can be switched into at least three selectively assumable operating modes (A, B, C), and which is designed so that (i) in a first operating mode (A), the anti-rotation lock (41) and the anti-lift lock (42) are activated, (ii) in a second operating mode (B), the anti-rotation lock (41) is inactive and the anti-lift lock (42) is active, and (iii) in a third operating mode (C), the anti-rotation lock (41) and the anti-lift lock (42) are inactive, and the retaining plate (12) is rigidly connected to the top face (13) of a gliding board body and is immobile in the direction perpendicular to it both when the anti-rotation lock (41) is deactivated in order to change the position of angular rotation (20) and when the anti-lift lock (42) is deactivated in order to remove or fit the base plate (11).

2. Binding mechanism according to claim 1, wherein the setting and fixing device (23) is designed so that, on assuming the second operating mode (B), the base plate (11) is mounted so that it is able to turn relative to the retaining plate (12) and is retained by means of the anti-lift lock (42) of the retaining plate (12), which remains active, at least approximately free of clearance in the vertical direction with respect to the top face (13) a gliding board body.

3. Binding mechanism according to claim 1, wherein the anti-lift lock (42) and also the anti-rotation lock (41) is provided in the form of at least one slide element (24, 25) mounted so as to be displaceable on the retaining plate (12).

4. Binding mechanism according to claim 1, wherein the setting and fixing device (23) has a common actuator drive (44) which is actively connected, in particular coupled in displacement with, both the anti-rotation lock (41) and the anti-lift lock (42).

5. Binding mechanism according to claim 4, wherein the actuator drive (44) is designed so that it acts simultaneously on the anti-rotation lock (41) and anti-lift lock (42), and deactivation of the anti-rotation lock (41) and deactivation of the anti-lift lock (42) take place at different times, one in advance of the other or one lagging behind the other.

6. Binding mechanism according to claim 1, wherein the anti-rotation lock (41) and the anti-lift lock (42) are provided with a common actuator drive (44) coupling them in displacement for deactivating the anti-rotation lock (41) and anti-lift lock (42) synchronously but functionally shifted in phase.

7. Binding mechanism according to claim 1, wherein the anti-lift lock (42) is activated in the first and in the second operating mode (A, B) of the setting and fixing device (23) and is inactive exclusively in the third operating mode (C).

8. Binding mechanism according to claim 1, wherein the setting and fixing device (23) can be switched from one of its three operating modes (A, B, C) exclusively into an immediately adjacent operating mode (A, B, C), next higher one and/or next one.

9. Binding mechanism according to claim 1, wherein the setting and fixing device (23) can be switched from the first operating mode (A) into the second operating mode (B) and then into the third operating mode (C) and from the third operating mode (C) into the second operating mode (B) and then back into the first operating mode (A).

10. Binding mechanism according to claim 1, wherein the setting and fixing device (23) has at least one slide element (24, 25) displaceably mounted on the retaining plate (12), which has toothing (46) in its end portion (30) facing away from the center of the retaining plate (12) constituting a part-component of the anti-rotation lock (41), which toothing (46) can be moved selectively into and out of engagement with lock toothing (40) around the orifice (15) in the base plate (11).

11. Binding mechanism according to claim 10, wherein the lock toothing (40) and the toothing (46) of the at least one slide element (24, 25) matching it has tooth flanks (71) extending perpendicular to the standing plane (19), and these tooth flanks (71) can be selectively moved into and out of engagement with the lock toothing (40) on the base plate (11) by a relative displacement of the at least one slide element (24, 25) in the radial direction with respect to the retaining plate (12).

12. Binding mechanism according to claim 10, wherein when the setting and fixing device (23) assumes the second operating mode (B), tooth flanks (71) of the toothing (46) terminate at least flush with an outer surface (48) of the retaining plate (12) or are positioned set back from the surface (48) of the retaining plate (12) in the direction towards the center of the retaining plate (12).

13. Binding mechanism according to claim 1, wherein the setting and fixing device (23) has at least one first slide element (24) which has toothing (46) in a bottom plane (45) extending essentially parallel with the standing plane (19) constituting a part-component of the anti-rotation lock (41) and has at least one retaining projection (43) in a top plane (47) extending above in the vertical direction and essentially parallel with the bottom plane (45) constituting a part-component of the anti-lift lock (42).

14. Binding mechanism according to claim 13, wherein the setting and fixing device (23) has at least one other slide element (25) which has toothing (46) exclusively at its terminal end facing away from the center of the retaining plate (12) constituting a part-component of the anti-rotation lock (41).

15. Binding mechanism according to claim 13, wherein an oblique surface (65) is provided on the bottom face of the retaining projections (43), which extends at an angle or incline with respect to the top face (32) of the base plate (11).

16. Binding mechanism according to claim 1, wherein the retaining plate (12) has a surface (48), at least portions of which are of a cylindrical or frustoconical shape, and form a pivot bearing (16) for the base plate (11) relative to the retaining plate (12) in combination with matching surfaces (49) of an orifice (15) in the base plate (11) when the setting and fixing device (23) is switched into the second operating mode (B).

17. Binding mechanism according to claim 1, wherein the setting and fixing device (23) is designed so that on assuming the second operating mode (B), a pivot bearing (16) between the retaining plate (12) and base plate (11) is released so that the base plate (11) is able to move relative to the retaining plate (12) within a horizontally extending standing plane (19) but a displacement of the base plate (11) in the vertical direction relative to the standing plane (19) or in the vertical direction relative to the retaining plate (12) is prevented virtually without any clearance because the anti-lift lock (42) remains active and prevents the base plate (11) from lifting relative to the top face (13) of a gliding board body.

18. Binding mechanism according to claim 1, wherein a common actuator drive (44) is provided for at least two, preferably four, slide elements (24, 25).

19. Binding mechanism according to claim 18, wherein the slide elements (24, 25) are mounted on or in the retaining plate (12) and are mounted so as to be displaceable in translation and/or in rotation in the radial or tangential direction relative to the retaining plate (12).

20. Binding mechanism according to claim 18, wherein, depending on the relative position with respect to the retaining plate (12) and base plate (11), at least individual ones of the slide elements (24, 25) either (i) establish an active anti-lift lock (42) and active anti-rotation lock (41), (ii) an active anti-lift lock (42) and inactive anti-rotation lock (41) or (iii) an inactive anti-rotation lock (41) and inactive anti-lift lock (42).

21. Binding mechanism according to claim 1, wherein the setting and fixing device (23) has a rotatably mounted pinion (35) which sits in a meshing connection with toothed rack portions (38, 39) of the slide elements (24, 25).

22. Binding mechanism according to claim 21, wherein the setting and fixing device (23) has a handle (50) which is mounted so as to be pivotable about a pivot axis (51) extending transversely to an axis (37) of the pinion (35).

23. Binding mechanism according to claim 22, wherein the handle (50) can not be switched into a downwardly pivoted locking position (52) lying flat except when the setting and fixing device (23) has assumed the first operating mode (A) in which the anti-rotation lock (41) and the anti-lift lock (42) are active.

24. Binding mechanism according to claim 23, wherein when the handle (50) assumes its locking position (52), it is secured in a recess (53) in the top face (54) of the retaining plate (12) so that it can not turn.

25. Binding mechanism according to claim 21, wherein the pinion (35) is able to turn within a limited range of angular rotation (62), and the start and end values of this range of angular rotation (62) respectively define the first and third operating mode (A and C), and the second operating mode (B) is defined between these start and end values of the total range of angular rotation (62).

26. Binding mechanism according to claim 25, wherein the range of angular rotation (62) of the pinion (35) is limited by a minimum and a maximum stop (63, 64) at the ends of the displacement path of at least one of the slide elements (24, 25).

27. Binding mechanism according to claim 1, wherein the setting and fixing device (23) has a rotatably mounted coupling disc (66) which is coupled with at least one slide element (24; 25) in displacement by means of at least one connecting rod (67).

28. Binding mechanism according to claim 1, wherein the setting and fixing device (23) has a rotatably mounted coupling disc (66) which is coupled with at least one slide element (24; 25) in displacement by means of at least one slide guide (68) and a guide block (69) guided therein.

29. Binding mechanism according to claim 28, wherein the guide block (69) is provided in the form of a bolt-type projection on the coupling disc (66), which engages in a slide guide (68) on the slide element (24; 25) co-operating therewith.

30. Binding mechanism according to claim 29, wherein the slide guide (68) is of an arcuately curved design and is made up of several radii or a varying pitch relative to the actuation direction of the slide elements (24; 25) so that varying adjustment distances can be achieved for the slide element (24; 25) for identical steps of angular rotation of the setting and fixing device (23).

31. Binding mechanism according to claim 1, wherein a total of four slide elements (24, 25) are distributed around the circumferential region of the retaining plate (12), and a first pair of slide elements (24) is coupled via connecting rods (67) and a second pair of slide elements (25) is coupled via slide guides (68) so as to move in displacement with the common actuator drive (44), in particular in the form of a rotatably mounted coupling disc (66).

* * * * *

UNITED STATES PATENT AND TRADEMARK OFFICE

CERTIFICATE OF CORRECTION

PATENT NO. : 8,052,157 B2
APPLICATION NO. : 12/283369
DATED : November 8, 2011
INVENTOR(S) : Holzer It is certified that error appears in the above-identified patent and that said Letters Patent is hereby corrected as shown below:

In particular, in Column 23, line 18 (Line 6 of Claim 1) after the word "necessary" please delete: "shoe (5)".

In Column 25, line 41 (Line 4 of Claim 22) after "pinion (35)" please insert the following: -- or a coupling disc (66) --.

In Column 26, line 5 (Line 2 of Claim 25) after "pinion (35)" please insert the following: -- or a coupling disc (66) --.

In Column 26, line 13 (Line 2 of Claim 26) after "pinion (35)" please insert the following: -- or a coupling disc (66) --.

Signed and Sealed this
Twenty-ninth Day of January, 2013

David J. Kappos

David J. Kappos
*Director of the United States Patent and Trademark Office*